US006063148A

United States Patent [19]

Fischbacher

[11] Patent Number: 6,063,148

[45] Date of Patent: May 16, 2000

[54] GRINDING TOOL WITH A METAL-SYNTHETIC RESIN BINDER AND METHOD OF PRODUCING THE SAME

[75] Inventor: Markus Fischbacher, Walchsee, Austria

[73] Assignee: Tyrolit Schleifmittelwerke Swarouski K.G., Tirol, Austria

[21] Appl. No.: 08/973,085

[22] PCT Filed: Feb. 7, 1997

[86] PCT No.: PCT/IB97/00099

§ 371 Date: Oct. 6, 1997

§ 102(e) Date: Oct. 6, 1997

[87] PCT Pub. No.: WO97/29886

PCT Pub. Date: Aug. 21, 1997

[30] Foreign Application Priority Data

Feb. 14, 1996 [AT] Austria ..... 253/96

[51] Int. Cl.[7] ..... B24D 3/06; B24D 3/28

[52] U.S. Cl. ..... 51/293; 51/298; 51/307; 51/309

[58] Field of Search ..... 51/293, 298, 309, 51/307

[56] References Cited

U.S. PATENT DOCUMENTS

| | | | |
|---|---|---|---|
| 3,650,715 | 3/1972 | Brushek et al. | 51/298 |
| 4,042,347 | 8/1977 | Sioui | 51/309 |
| 4,369,046 | 1/1983 | Bruschek et al. | 51/309 |
| 5,314,512 | 5/1994 | Sexton | 51/298 |

FOREIGN PATENT DOCUMENTS

WO9729886 8/1997 WIPO .

OTHER PUBLICATIONS

Abstract for Japanese Application No. 03026099 Sep. 1992 Publication No. 4269172.
Abstract for Japanese Application No. 62057851 Mar. 1987 Publication No. 63221976.
Abstract for Japanese Application No. 03242888 Dec. 1992 Publication No. 4372368.
Abstract for Japanese Application No. 62218633 Mar. 1989 Publication No. 1064766.
Abstract for Japanese Application No. 60169238 Feb. 1987 Publication No. 62028176.

*Primary Examiner*—Michael Marcheschi
*Attorney, Agent, or Firm*—Rankin, Hill, Porter & Clark LLP

[57] ABSTRACT

Grinding tool for the machining of particularly brittle materials, whose abrasive rim bond is constructed of two components, whereby one component consists of resinoid such as, for example, high temperature thermoplast or pressure sintered polymer and a second component of low melting sintered metal. The processing temperature of both components by the joint pressure sintering is the same. The nature of the invention consists in the construction of a particular connected network for each of the two different bonding agents and their interrelated spatial intertwining in the abrasive rim to an interpenetrating network. A process for the production of abrasive rims for grinding tools according to the invention is indicated.

10 Claims, No Drawings

GRINDING TOOL WITH A METAL-SYNTHETIC RESIN BINDER AND METHOD OF PRODUCING THE SAME

FIELD OF INVENTION

The invention applies to a grinding tool for the machining of particularly brittle materials such as natural and artificial stone, sintered tungsten carbide, ceramics and similar, whereby the grinding tool is composed of one piece or preferably several pieces, namely a core and an abrasive rim, and the grinding tool or rather its abrasive rim is manufactured out of super abrasive such as diamond, metallic bonding agent, resinoid bonding agent and if necessary, filler.

Furthermore, the invention applies to a process for the production of such an abrasive rim.

BACKGROUND

Grinding tools of the above-mentioned type can not only be used in dry but also in wet grinding processes. The application areas are the machining of natural and artificial stone, with grinding tools preferably made of several pieces in, for example, grinding and polishing stations for decorative stone materials, with production and repair grinding of tools for metal cutting machining which completely or partly consists of hardened tool steel, carbide or ceramics.

The patent document U.S. Pat. No. 3,650,715 indicates a grinding wheel bond which contains dendritic metal as filler in polyimide resin. The metal is in "clusters of dendritic metal particles," or as accumulations of dendrites. The above-mentioned patent document proposes heat-resistant polyimide resin for use in grinding tools subject to high stresses especially for dry grinding applications. To dissipate the heat arising with grinding and for the additional support of the abrasive grains in the resinoid bond matrix, copper and silver are preferred mixed in as filler. As a result, grinding wheels are proposed by which the soft contact of resinoid bonded grinding wheels and the thermal conductivity and stability of metal bonds are striven for in one tool.

A part of the resinoid bonded diamond grinding wheels for high heat stress or for high surface pressure on the abrasive coating, obtainable on the market, are based on the proposed bond type in the U.S. Pat. No. 3,650,715 patent.

The Japanese publication JP-A-516074 (Sintocogio Ltd.) describes a grinding wheel with higher density and strength, by which with the use of super abrasive no dimensional deviation is produced on the material to be machined. At the same time thermoplastic, temporary binder with a mixture of super abrasive and metal powder are heated in such a way that the thermoplastic binder is initially softened then liquified and granulated during the tempering. The granulated mixture is heated up once again in the mold up to liquefaction in order to obtain the "green" grinding wheel. The "green" wheel is sintered after the removal of the temporary binder.

U.S. Pat. No. 4,369,046A describes the combined shaping of both parts of a grinding wheel, namely the resinoid bonded abrasive coating and the metal bonded core, in order to then obtain a uniform grinding wheel. The inventors were confronted by problems well-known to technical specialists concerning very different tasks of abrasive coating and core, with their very different material characteristics. Accordingly, the subject matter of this invention is a combined shaped article with a resinoid bonded phase and a metal bonded phase, whereby the resinoid bonded phase is intended for the abrasive coating and the metal bonded phase for the core, and a volume percentile of the powder of each phase can be mixed to the other phase. The volume percentile of one phase in the other phase should as a result only move between 0–30%.

A further subject matter of this invention is an accompanying process for the combined shaping of grinding wheels with a resinoid bonded phase and a metal bonded phase through simultaneous application of heat and pressure on both mixtures which are to be molded, for the abrasive coating and for the core.

In fact, in the U.S. Pat. No. 4,369,046A mixtures from one component are proposed with the other component, however, only as filler and in order to reduce the sudden transition of the characteristic profile in the separation zone from abrasive coating to core. This guarantee the processibility of components with inevitably very different characteristics which interfere with each other, on which the increasing of the melting point of the metal powder for the core points to at least 100° C. over the molding temperature.

SUMMARY OF INVENTION

The present invention provides a grinding tool for the machining of particularly brittle materials, whose abrasive rim bond is constructed of two components, whereby one component consists of resinoid such as, for example, high temperature thermoplast or pressure sintered polymer and a second component of low melting sintered metal. The processing temperature of both components by the joint pressure sintering is the same. The nature of the invention consists in the construction of a particular connected network for each of the two different bonding agents and their interrelated spatial intertwining in the abrasive rim to an interpenetrating network. A process for the production of abrasive rims for grinding tools according to the invention is provided below. The advantage of the higher bonding forces of the metal bond with the advantage of the higher elasticity of the resinoid bond, can be achieved with the invention in one grinding tool.

It is a task of the invention to indicate an improved grinding wheel which with the use of heat-resistant resins and metal alloys as bond raw materials makes possible an improvement of the grinding characteristics an increase of the stock removal rate and a more economical utilization of the expensive super abrasive. A further task of the invention is to indicate a process by which such a grinding wheel is able to be produced.

According to the invention this task is solved by the abrasive rim being constructed using at least two different bond systems, namely a metallic bonding agent and a resinoid bonding agent, that the different bonding agents are always sintered to a connected network, that the different networks show a spatial network structure intertwining with each other, and that the abrasive grain and, if necessary, the filler is located within at least one of the different bonding agents and/or in the interphase area between the different bonding agents.

The two bond networks, intricately bound in each other, extend as a result over the entire abrasive rim. This is in contrast to such a tool according to the state of the art where the metal component of the bond appears as accumulations of filler particles in a resinoid matrix. At the same time it was recognized that by adapting the sintering capability of the metallic component and the resinoid component of the bond to each other, a more secure formation is able to be achieved of two contacting networks made up of completely different materials. The sintering capability is then nominated through the identical sintering temperature by the pressure sintering for both basic network materials. Between the bridges or within the bridges of each one or the bond networks, abrasive grains and if necessary, filler particles are embedded. In the course of the formation of both networks during the pressure sintering process, abrasive grains can be enclosed in the metallic area as well as the area of the resinoid bond part and be bonded in for later contact with the workpiece.

In accordance with the invention, a very good support effect in the bond structure is achieved similar to the hardening effect of reinforcing steel in concrete, through the existence of the metal bond share in the form of an extensive metal intertwining. In contrast, the resinoid network embedded in between is responsible for the "spring effect" and a vibration damping of the abrasive grains by their entry into the brittle workpiece surface.

According to the invention, the sintering capability of the metal bond component is adapted to that of the respective resinoid bond component of the bond. This occurs through selection of the alloy composition of the metallic bond component with regard to load test point and liquid phase formation.

A development of the invention is possible if the resinoid bonding material is a high temperature thermoplast and an appropriately low sintering alloy is selected for the metallic network, which can preferably be a bronze with a composition of 60 percent by volume copper and 40 percent by volume tin. The formation of both intertwined networks, one below another, according to the invention, is then only achieved by the maximum processing temperature of the high temperature thermoplast of 300° C.

A further design form of the invention is possible if the network of resinoid bonding material is made of a thermosetting, pressure sintering polymer through cross-linkage. This polymer comes from the polyimide group. Likewise in this form of the invention the appropriate metal bond network can be preferably formed from a bronze. The associated pressure sintering temperature in this design form amounts to 400 up to 500° C., in order to construct a sintered metal bonded and resinoid bonded spatial network.

The U.S. Pat. No. 3,650,715 for example, includes "malleable metal" in the form of filler accumulations, which are embedded in the resinoid matrix. Through this arrangement structure the effects according to the invention are not able to be achieved. In contrast, according to the invention it is intended that the metal component of the bond acts as supporting, intertwined reinforcing. An additional advantage is gained through this in that a bronze, mainly a brittle bronze, tends less to clogging of the grinding wheel surface or the cutting edges of the abrasive grains by the grinding contact with the workpiece, than that which could easily occur by ductile metal.

Alongside the preferred design examples, a series of variations of the described basic ideas of the invention is possible depending on the raw materials obtainable on the market, especially depending on the resinoid characteristics.

A further development of the idea of the invention is possible, if in adjustment to the relatively lower processing temperatures for the resinoid bond network, low sintering alloys are used, which can also then be mostly ductile and lubricating by the grinding application, as mentioned above. In this case only an inorganic filler such as silicon carbide, aluminum oxide, baryt, quartz, graphite or the like in the preferred grain quality of less than 100 microns needs to be added for increasing the brittleness characteristics in the powder for the networks.

The invention has identified that considerable improvements are possible by the structure of grinding wheels containing super abrasive cutting material on the basis of the declared bonding agents such as high temperature resins and sintered metal alloys. The achievable improvements are tied to the manufacturing process.

The designated manufacturing steps of the invention can be modified depending on the high temperature bond resins used, without leaving the invention concept. By using a high temperature thermoplast a common sintering temperature of higher than 300° C. is intended for the pressure sintering. By using a pressure sintering polymer from the polyimide group, the common pressure sintering temperature for the formation of each of the networks of metal bond and resinoid bond can be increased up to about 500° C. The most important aspect here is that the pressure sintering capability of the metal bond share is already given by a temperature which lies at least 10° C. below the actual degradation temperature of the resinoid bond share.

The invention makes good use of the surprising discovery that the joint pressing and sintering and the joint pressure sintering pressing leads to two completely different kinds of bond powder, each to one bond part in the abrasive rim. It is only important here to bring the sintering temperature of the metallic bond component near to the processing temperature of the resinoid bond component when using a high temperature thermoplast. By the use of thermally hardened pressure sintered polymer, its special hardening temperature also has to be the basis for the bringing near of the sintering temperature of the metallic bond component. As a result, decisive for the joint sintering temperature is that processing temperature of the bond resin, by which still sufficient distance to the degradation of the resin remains. This minimum distance appears with about 10° C.

In a development of the manufacturing process according to the invention, the bringing near of the sintering capability of the metallic bond component to that of the resinoid bond component is brought about through a bronze powder modified with tin. At the same time it was discovered that additional tin powder of grit size from 2 up to 50 microns makes the adaption of the sintering conditions to the requirements of the resinoid bond processing substantially easier.

By the use of a high temperature thermoplast as resinoid component of the abrasive rim bond, especially low joint processing temperatures from 300° C. upwards are required in order to also guarantee the safe formation of the metal bond network. In these cases it has turn out, as is known, that bismuth in the presence of copper and tin enables the sintering capability through the formation of especially low melting structural components.

In the following two production examples of abrasive rims made according to the invention are described:

EXAMPLE I

For dry grinding, milling cutter tipped with tungsten carbide of the P20 type, on a Strausack tool grinding machine, the abrasive coating was manufactured for a D11V9 cup wheel. A bond powder was mixed in a Turbula mixer with a 60 percent by volume 70/30 copper-tin-bronze of the 25 GR type from the Poudmet Company of France with an average grit size of 30 microns, and a 40 percent by volume high temperature thermoplast of the "P84HT" type from the HPP Company (formerly known as the Lenzing Company) of Austria with a diamond abrasive of the RVG-D type from the General Electric Company/USA with the grit size US mesh 120/140. The quantity of the diamond abrasive was measured in such way that a concentration of C75 (3.3 carats per $cm^3$) was made in the finished abrasive coating.

The powder resin contained 2 percent tin powder of the "75F" type from the Pometon Company of France as fluxing agent and for the adjustment of the sintering capability of the different bond networks to be formed.

All starting material was dried.

The joint pressure sintering occurred in the abrasive coating mold at 370° C. during 20 minutes of nitrogen atmosphere at a pressure of 20,000 N $cm^{-2}$.

The abrasive coating was molded at 300° C. and underwent no aftercuring.

EXAMPLE II

Intermittent head segments were manufactured for the tipping of the No. 9 station of a 24 station Breton machine. Granite plates of medium machinability were machined in the through feed process with wet grinding and water as flushing agent.

For the production of the abrasive coating a mixture was mixed for 20 minutes in a Turbula mixer, made of 8.5 percent by volume tin powder of the "75F" type from the Pometon Company of France with average grit size of 30 microns, 51.5 percent by volume 80/20 bronze of the "25GR" type from the Poudmet Company of France with an average grit size of 50 microns, 40 percent by volume powder resin of the "Vespel SP1A" type from the Du Pont Company with an average grit size of 50 microns and diamond abrasive grain of the "MDAS" type from the De Beers Company of Germany with the grit size US mesh 230/270. The starting material was predried and mixed without additions. The diamond content for the finished abrasive coating was designed with a concentration of C18 (=0.79 carat/$cm^2$).

This abrasive coating mixture was prestressed cold in the pressing mold with 2000 N $cm^{-2}$. Subsequently the abrasive coating mixture was sintered in the same pressing mold at 490° C. and a holding time of 20 minutes in nitrogen atmosphere at 22,000 N $cm^{-2}$. After the pressure sintering an unpressurized aftercuring of the abrasive coating occurs under nitrogen atmosphere and temperatures of 300–400° C. over a time period of 16 hours.

With grinding tools according to the invention the advantages of the metal bond with the advantages of the resinoid bond can be realized to the greatest possible extent in one tool. In this way the higher bonding force of the metallic network occurs at the same time together with the elasticity and vibration damping action of the resinoid bond. The compression stress of abrasive coatings according to this invention can be increased. Through the connected metallic bond network a good thermal compensation of the grinding temperature results.

Thus, it will be appreciated that the invention provides a grinding tool for the machining of particularly brittle materials such as natural and artificial stone, sintered tungsten carbide, ceramics and similar, whereby the grinding tool is composed of one-piece or preferably several pieces, namely a core and an abrasive rim, and the grinding tool or rather its abrasive rim is manufactured out of super abrasive such as diamond, metallic bonding agent, resinoid bonding agent and if necessary filler, characterized in that, the metallic bonding agent and the resinoid bonding agent are each sintered to a connected network, that the metal bond network and the resinoid bond network form an intertwining, connected, double spatial network penetrating each other and, that the abrasive grain and if necessary, the filler is located within at least one of the different bonding agents and/or in the interphase between the different bonding agents.

The resinoid bond network consists of a resin from the high temperature thermoplast group such as polyamideimides, polyetheretherketones, polyarylsulfones, liquid crystal polymer, polyphenylene sulfides, silicon resins, polyimides and the metal bond network consists of a pressure sintering capable metal or an alloy of at least two metals from the well-known group of bond metals such as silver, copper, aluminum, tin, zinc, cadmium, lead, antimony and bismuth.

The resinoid bond network may be made up of a cross-linking (thermosetting) pressure sintered polymer with high temperature stability from the polyimides group and the metal bond network of a pressure sintering capable metal from the well-known group of bond metals such as silver, copper, aluminum, tin, zinc or an alloy of at least two of these metals.

The metal bond network may consist of a bronze with 50 to 98 weight percent copper and 50 to 2 weight percent tin. Also, the metal bond network may consist of brittle bronze with 38–64 weight percent copper and 36–62 weight percent tin. The metal bond network may contain an inorganic filler from the carbide group, oxide or similar for increasing the brittle fracture tendency with a grit size of preferably 100 microns maximum. Preferably, the volume share of the metal bond network in the abrasive rim to the volume share of the resinoid bond network is in a range from 20:80 up to 80:20, preferably 30:70.

The invention also provides a process for the production of a super abrasive and if necessary, filler in an abrasive rim of a grinding tool containing a bond characterized by the production steps: A) dry mixing of at least one metallic bond powder and at least one resinoid bond powder with the same sintering capability and if necessary, a filler, to a bond powder; B) cold prepressing of the bond powder to a green compact after addition of the abrasive at room temperature preferably without moistening agent; C) joint pressure sintering of the metallic bonding agent and the resinoid bonding agent of the green compact at a sintering temperature at least 10° C. below the degradation temperature of the resinoid bonding agent; and D) fusion of the resinoid bonding agent and the metallic bonding agent, each to a connected, intertwined with each other spatial network, whereby the abrasive grains and if necessary, the filler particles present are bonded within at least one of the networks but preferably within both networks and/or in the interphase area between both networks.

The production of the abrasive rim can be accomplished through joint pressure sintering of a high temperature thermoplast from the group of the polyamideimides, polyetheretherketones, polyarylsulfones, liquid crystal polymer, polyphenylene sulfides, silicon resins, polyimides and an alloy of at least two metals from the group of Cu, Sn, Zn, Ag, Pb, Al, Bi in a temperature range starting at 300° C. and ending 10° C. below the degradation temperature of the high temperature thermoplast used and at a pressure of 5000 to 30,000 Newton per square centimeter (N $cm^{-2}$).

The production of the abrasive rim can also be accomplished through joint pressure sintering of a cross-linking (thermosetting) pressure sintered polymer from the polyimides group and an alloy from at least two metals from the group of copper, tin, zinc, silver, aluminum at a temperature range starting at 400° C. and ending 10° C. below the degradation temperature of the resinoid used and a pressure of 5,000 to 30,000 Newton per square centimeter (N $cm^{-2}$). Chemical thermosetting of the polyimide network formed by joint pressure sintering at temperatures up to 400° C. and a duration of up to 24 hours in the unpressurized sintering molds (inserts) can also be employed.

I claim:

1. A grinding tool for machining brittle materials comprising a core and an abrasive rim, said abrasive rim comprising a super abrasive, a metallic bonding agent, a resinoid bonding agent and optionally a filler, wherein the metallic bonding agent and the resinoid bonding agent are each sintered to form a connected network, and the metal bond network and the resinoid bond network form an intertwining, connected, double spatial network penetrating each other, and further wherein said abrasive and optionally the filler are located within at least one of the bonding agents and/or in the interphase between the bonding agents.

2. A grinding tool according to claim 1 wherein the resinoid bonding agent is selected from the group consisting of polyamideimides, polyetheretherketones, polyarylsulfones, liquid crystal polymer, polyphenylene sulfides, silicon resins and polyimides and the metallic bonding agent is selected from the group consisting of alloys of at least two metals selected from silver, copper, aluminum, tin, zinc, cadmium, lead, antimony or bismuth.

3. A grinding tool according to claim 1 wherein the resinoid bonding agent consists of a cross-linking pressure sintered polyimide polymer and the metallic bonding agent consists of silver, copper, aluminum, tin, zinc or an alloy of at least two of these metals.

4. A grinding tool according to any one of claims 1 to 3, wherein the metallic bonding agent consists of 50 to 98 weight percent copper and 50 to 2 weight percent tin.

5. A grinding tool according to any one of claims 1 to 3, wherein the metallic bonding agent consists of 38 to 64 weight percent copper and 36 to 62 weight percent tin.

6. A grinding tool according to any one of claims 1 to 3, wherein the metallic bonding agent contains an inorganic filler selected from carbides or oxides.

7. A grinding tool according to any one of claims 1 to 3, wherein the metallic bonding agent and the resinoid bonding agent in the abrasive rim are present in a volume ratio of 20:80 to 80:20.

8. A process for producing a grinding tool which contains a bond, said grinding tool comprises a core and an abrasive rim, said abrasive rim comprising a super abrasive, a metallic bonding agent, a resinoid bonding agent and optionally a filler, wherein the metallic bonding agent and the resinoid bonding agent are each sintered to form a connected network, and the metal bond network and the resinoid bond network form an intertwining, connected, double spatial network penetrating each other, and further wherein said abrasive and optionally the filler are located within at least one of the bonding agents and/or in the interphase between the bonding agents wherein the process comprises the steps of:

a. dry mixing at least one metallic bond powder, at least one resinoid bond powder, and optionally, a filler to form a mixed bond powder;

b. adding an abrasive to the mixed bond powder and cold pressing the mixture at room temperature to form a green compact;

c. joint pressure sintering the metallic bonding agent and the resinoid bonding agent present in the green compact at a sintering temperature of at least 10° C. below the degradation temperature of the resinoid bonding agent; and d. fusing the metallic bonding agent and the resinoid bonding agent present in the sintered compact to form a connected, intertwined spatial network.

9. A process for producing a grinding tool according to claim 8, wherein the resinoid bonding agent is selected from the group consisting of polyamideimides, polyetheretherketones, polyarylsulfones, liquid crystal polymer, polyphenylene sulfides, silicon resins and polyimides and the metallic bonding agent is selected from the group consisting of alloys of at least two metals selected from silver, copper, aluminum, tin, zinc, cadmium, lead, antimony or bismuth, and further wherein step c is accomplished at temperatures from 300° C. to within 10° C. below the degradation temperature of said resinoid bonding agent and at a pressure of from about 5,000 to 30,000 N/$cm^2$.

10. A process for producing a grinding tool according to claim 8, wherein the resinoid bonding agent consists of a cross-linking pressure sintered polyimide polymer and the metallic bonding agent consists of an alloy of at least two metals selected from silver, copper, aluminum, tin or zinc, and further wherein step c is accomplished at temperatures from 300° C. to within 10° C. below the degradation temperature of said resinoid bonding agent and at a pressure of from about 5,000 to 30,000 N/$cm^2$.

* * * * *